US007404388B2

(12) United States Patent
Bang

(10) Patent No.: US 7,404,388 B2
(45) Date of Patent: Jul. 29, 2008

(54) SYSTEM FOR AUTOMATICALLY CHANGING FUEL PASSAGES

(75) Inventor: Sung-Hoon Bang, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/904,852

(22) Filed: Sep. 28, 2007

(65) Prior Publication Data

US 2008/0135023 A1 Jun. 12, 2008

(30) Foreign Application Priority Data

Dec. 12, 2006 (KR) ..... 10-2006-0125994

(51) Int. Cl.
*F02M 17/30* (2006.01)

(52) U.S. Cl. ..... 123/198 D; 123/510; 123/514

(58) Field of Classification Search ..... 123/198 D, 123/514, 456, 446, 447, 510
See application file for complete search history.

(56) References Cited

U.S. PATENT DOCUMENTS 4,296,718 A * 10/1981 Baugh et al. ..... 123/198 D
4,319,550 A * 3/1982 Ishii et al. ..... 123/198 DB
5,103,783 A * 4/1992 Hanson et al. ..... 123/198 D
6,827,065 B2 * 12/2004 Gottemoller et al. ..... 123/456
7,114,490 B2 * 10/2006 Zdroik ..... 123/497
7,128,054 B2 * 10/2006 Koehler et al. ..... 123/446
7,287,517 B2 * 10/2007 Nozaki et al. ..... 123/514

FOREIGN PATENT DOCUMENTS

| | | |
|---|---|---|
| JP | 9032662 | 2/1997 |
| JP | 2002-180924 | 6/2002 |
| JP | 2004-027855 | 1/2004 |
| KR | 1020040069605 | 8/2004 |

* cited by examiner

*Primary Examiner*—Carl S Miller
(74) *Attorney, Agent, or Firm*—Peter F. Corless; Edwards Angell Palmer & Dodge, LLP

(57) ABSTRACT

The present invention provides a system which can automatically switch passages of a fuel supply line and a fuel return line when the pressure in a fuel return line becomes higher than a predetermined pressure. Even when the fuel supply and return lines are incorrectly connected, the present system can prevent the problem of damage to a fuel supply system and fuel leakage which may be caused by an increased fuel pressure.

7 Claims, 5 Drawing Sheets

SYSTEM FOR AUTOMATICALLY CHANGING FUEL PASSAGES

CROSS-REFERENCE TO RELATED APPLICATIONS

The present application is based on, and claims priority from, Korean Patent Application Serial Number 10-2006-0125994, filed on Dec. 12, 2006, the disclosure of which is incorporated herein by reference in its entirety.

FIELD OF THE INVENTION

The present invention relates to a system for automatically changing fuel passages for a diesel engine, and more particularly, to a system for automatically changing fuel passages, in which fuel passages can be automatically changed so as to prevent a problem that occurs when a fuel supply line and a fuel return line of a diesel engine are not properly assembled.

BACKGROUND OF THE INVENTION

In a common rail-type fuel supply system of a diesel engine in the related art, fuel from a fuel tank passes through a fuel filter to be supplied to a common rail through a high-pressure pump. In the common rail, fuel that is not injected to an injector returns to the fuel tank via a fuel return line. On the other hand, fuel that is discharged through an outlet of the pump returns to the fuel tank via the fuel return line after lubricating the high-pressure pump.

FIG. 1 shows a realization of the above-mentioned fuel supply system in an actual engine. As shown in FIG. 1, a fuel filter can be improperly assembled. If an operator incorrectly assembles the fuel filter, a fuel supply line and a fuel return line are not to be connected correctly, thereby making the fuel to be retrieved through the fuel return line lose its fluidity and supplying unpurified fuel to the high-pressure pump.

If the engine is operated under the condition mentioned above, pressure in the fuel return line is to increase gradually. When the pressure in the fuel return line is about 2 bar or more, parts forming the fuel supply system tend to deform to cause damages to the fuel supply system and fuel leakage.

SUMMARY OF THE INVENTION

Embodiments of the present invention provide a system for automatically changing fuel passages for a diesel engine that can automatically switch fuel passages of a fuel supply line and a fuel return line when the pressure in the fuel return line increases to a level higher than a predetermined pressure, thereby preventing damages to the fuel supply system and fuel leakage that are caused by the increased fuel pressure.

A system according to an embodiment of the present invention includes a case, a rotary member, a pressure switching unit, and an elastic member. The case includes a fuel supply line, a pump port, a return line port, a first variable port, and a second variable port. The fuel supply line is provided between a fuel filter and a high-pressure pump. The pump port is connected to an inlet of the high-pressure pump. A fuel return line is connected to a common rail and the high-pressure pump. The fuel return line and fuel supply line pass through the case. The return line port is provided with the return line. The first variable port is connected to the fuel filter. The second variable port is connected to a fuel tank.

The rotary member includes an initial supply passage, an initial return passage, a final supply passage, and a final return passage. The rotary member can rotate with respect to the case when the pressure in the fuel return line increases to a level higher than a predetermined pressure. The initial supply passage is rotatably provided in the case and connects the pump port to the first variable port before the rotation of the rotary member. The initial return passage connects the return line port to the second variable port. The final supply passage connects the pump port to the second variable port after the rotation of the rotary member. The final return passage connects the return line port to the first variable port.

The pressure switching unit maintains the state of the rotary member where the rotation of the rotary member is not performed, and allows the rotary member to rotate with respect to the case when the pressure in the fuel return line becomes higher than the predetermined pressure.

The elastic member rotates the rotary member with respect to the case when the rotary member comes into a rotatable state by the pressure switching unit.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present systems will be particularly useful with a wide variety of motor vehicles.

Other aspects of the invention are discussed infra.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
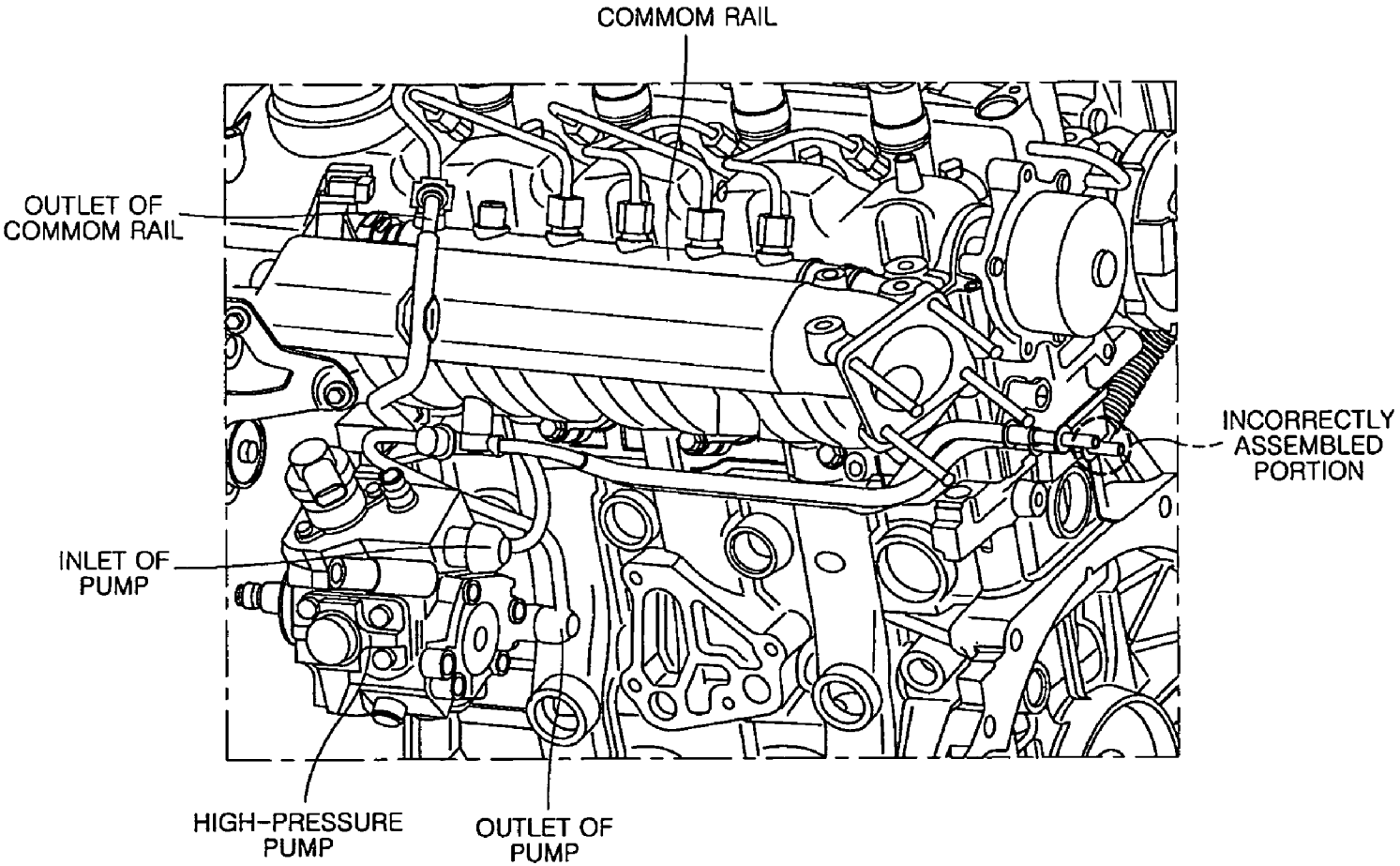
FIG. 1 is a view showing a part of a fuel supply system for a diesel engine according to the present invention.

Reference will now be made in detail to the preferred embodiment(s) of the present invention, examples of which are illustrated in the drawings attached hereinafter, wherein like reference numerals refer to like elements throughout. The embodiments are described below so as to explain the present invention by referring to the figures.

Figure 2:
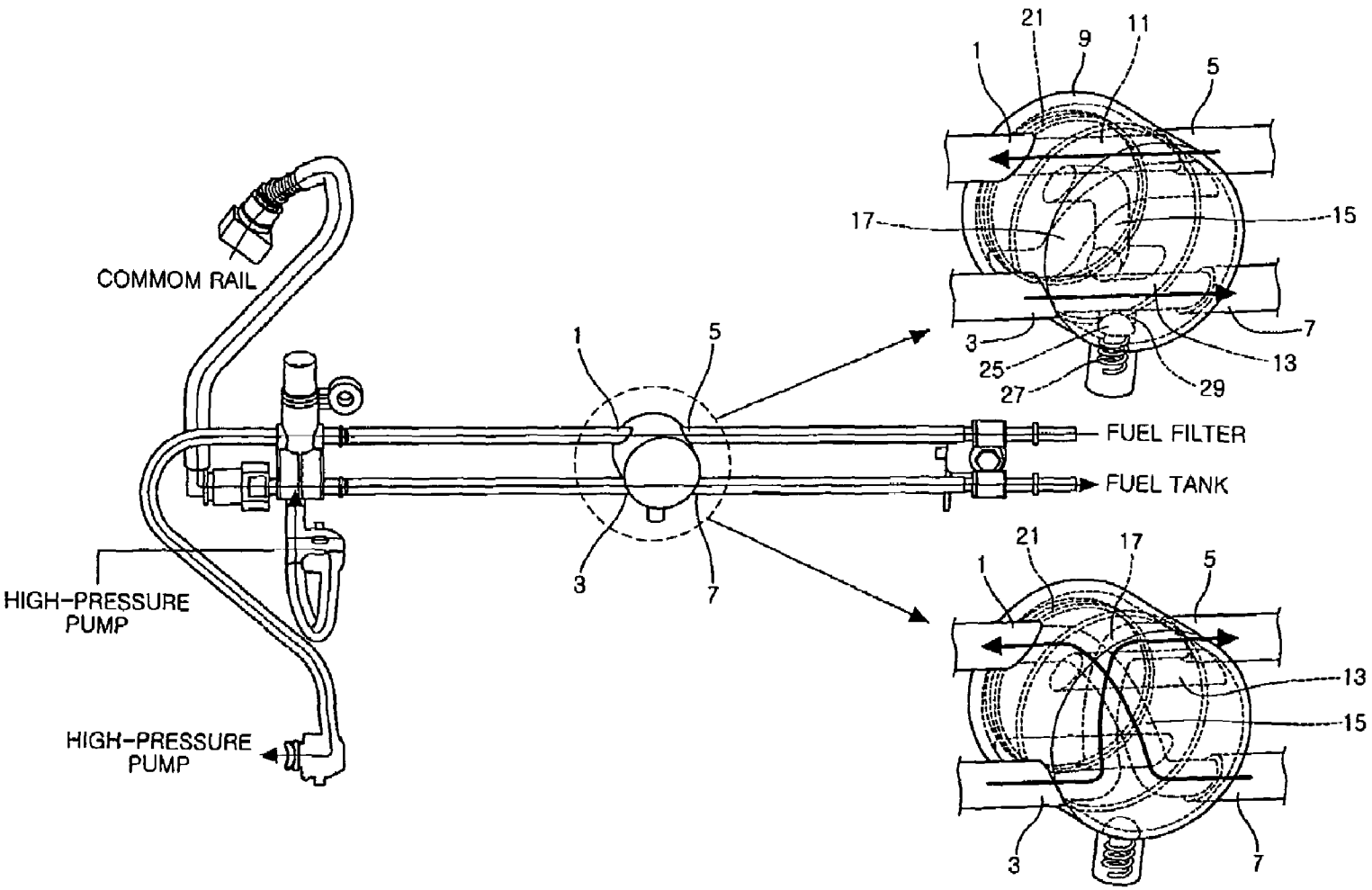
FIG. 2 is a view showing an automatic fuel passage changer for a diesel engine according to the present invention.
Figure 3:
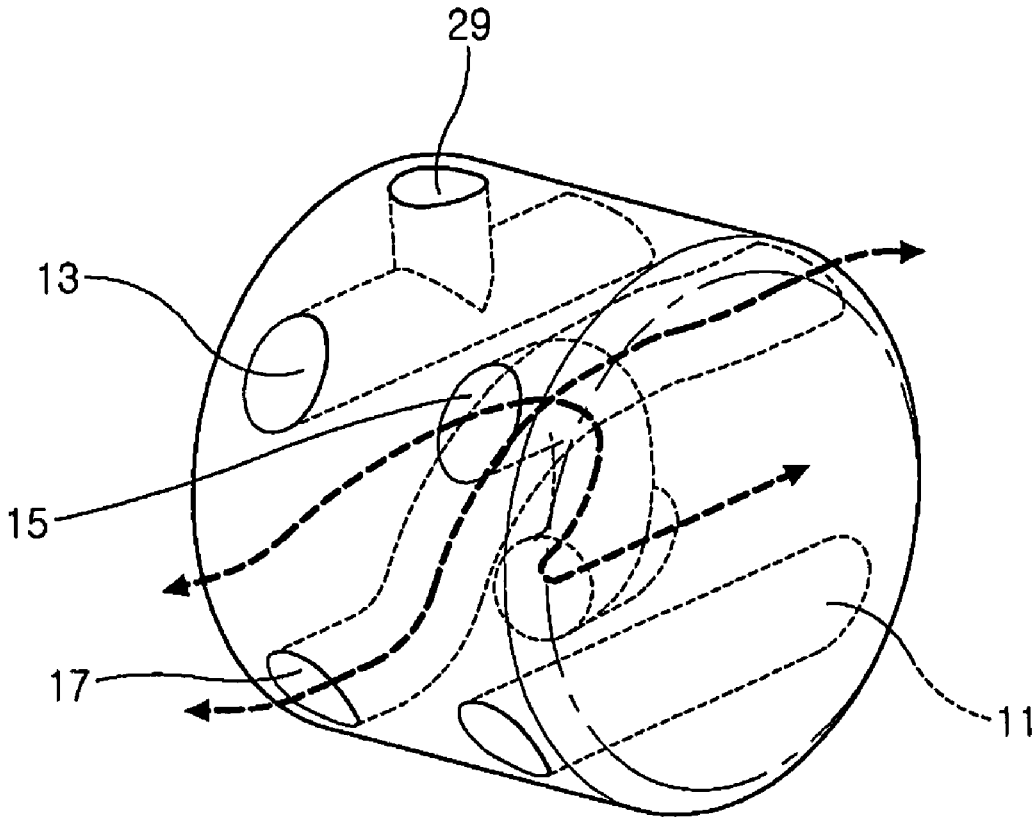
FIGS. 3 and 4 are views showing the rotary member shown in FIG. 2.
Figure 4:
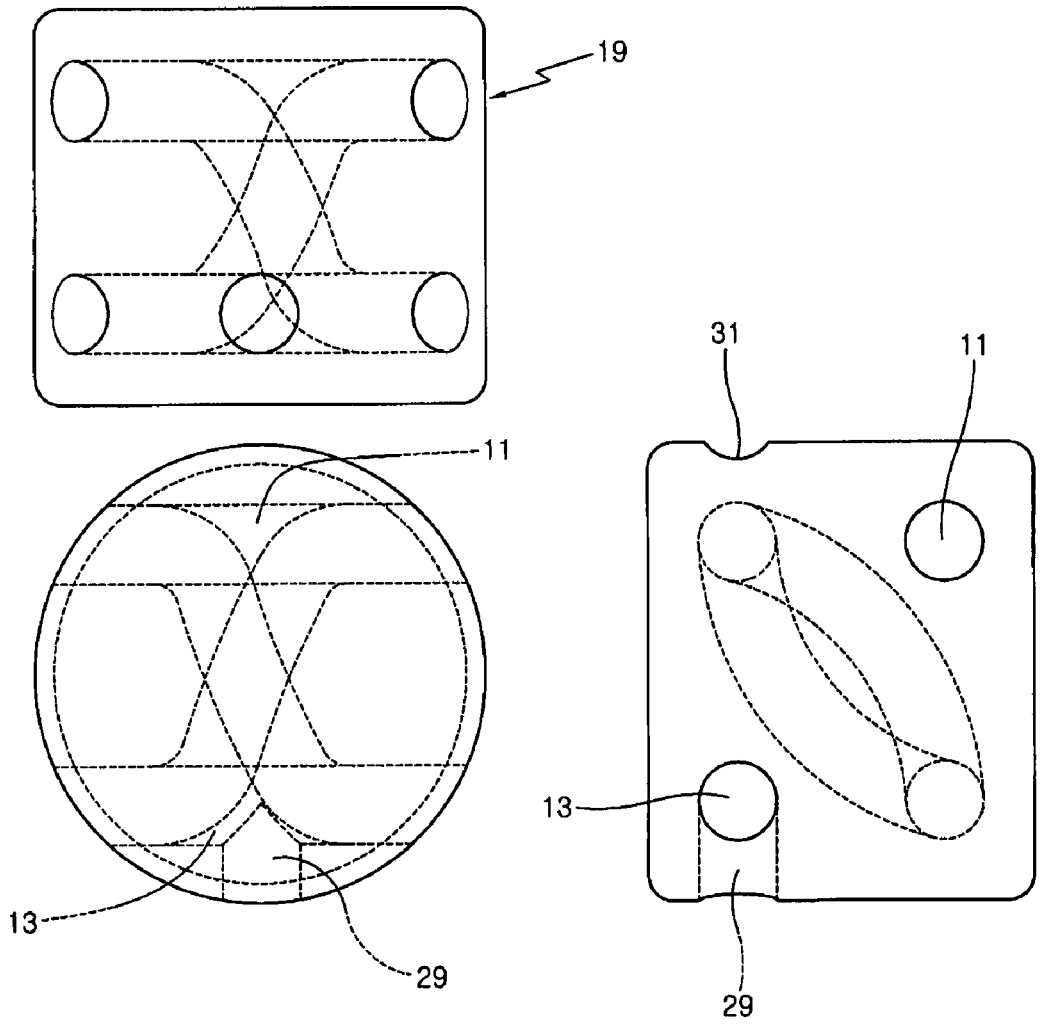
Figure 5:
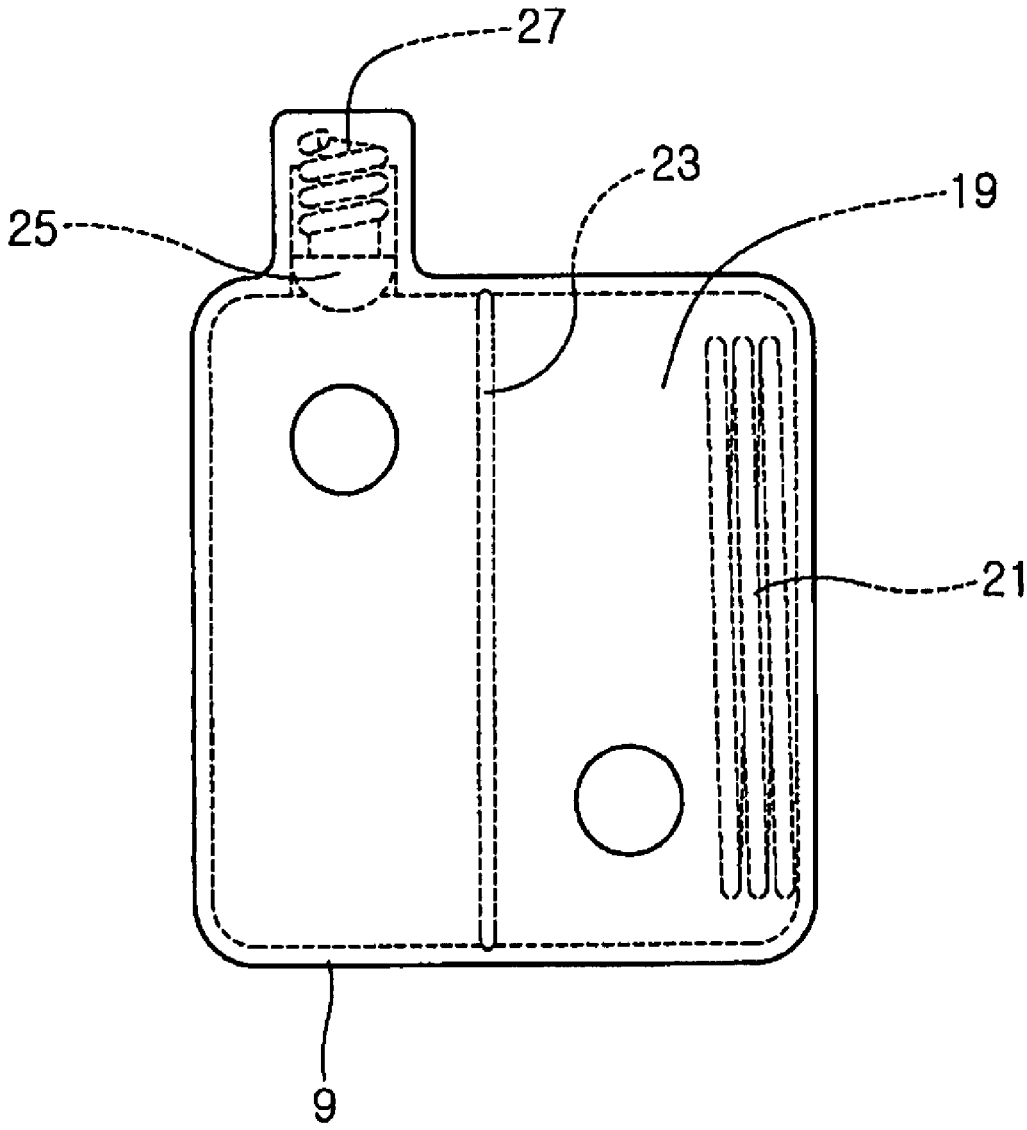
FIG. 5 is a view showing the automatic fuel passage changer for a diesel engine according to the present invention.

Referring to FIGS. 2 through 4, a system for automatically changing fuel passages according to an embodiment of the present invention includes a case 9, a rotary member 19, a pressure switching unit, and an elastic member 21. The case 9 includes a fuel supply line provided between a fuel filter and a high-pressure pump, a pump port 1 connected to an inlet of the high-pressure pump so that fuel return lines connected to a common rail and the high-pressure pump pass therethrough, a return line port 3 connected to the return line, a first variable port 5 connected to the fuel filter, and a second variable port 7 connected to a fuel tank.

The rotary member 19 includes an initial supply passage 11 that is rotatably provided in the case 9 and connects the pump port 1 to the first variable port 5 before the rotation of the rotary member and an initial return passage 13 that connects the return line port 3 to the second variable port 7 before the rotation of the rotary member. The rotary member 19 further includes a final supply passage 15 that connects the pump port 1 to the second variable port 7 after the rotation of the rotary member and a final return passage 17 that connects return line port 3 to first variable port 5 after the rotation of the rotary member.

The pressure switching unit maintains the state of the rotary member 19 before the rotation of the rotary member. It also allows the rotary member 19 to rotate with respect to the case 9 when the pressure in the fuel return line increases to a level higher than a predetermined pressure.

The elastic member 21 rotates the rotary member 19 with respect to the case 9 when the rotary member 19 is in a rotatable state by the pressure switching unit.

In other words, the initial supply passage 11 of the rotary member 19 serves as a fuel supply line and the initial return passage 13 serves as a fuel return line. If the pressure in the fuel return line increases abnormally, the rotary member 19 is rotated by the pressure switching unit and elastic member 21 so that the final supply passage 15 serves as a fuel supply line and final return passage 17 serves as a fuel return line.

The pump port 1 and the first variable port 5 are provided on an imaginary line passing through the case 9. The return line port 3 and the second variable port 7 are provided on another imaginary line passing through the case 9 so as to be parallel to the imaginary line formed by the pump port 1 and the first variable port 5.

Preferably, the case 9 has a cylindrical shape. The imaginary line formed by the pump port 1 and the first variable port 5 and the imaginary line formed by the return line port 3 and the second variable port 7 pass through the peripheral surface of the case 9 so as to be spaced apart from each other in a longitudinal direction of the cylindrical shape.

Also preferably, the rotary member 19 has a cylindrical shape similar to that of the case 9 so as to be rotatably inserted into the case 9. Further, it is preferable that a rotational bearing 23 be provided between the rotary member 19 and the case 9 to guide the rotation of the rotary member 19 with respect to the case 9 along the circumferential direction.

According to this embodiment, the pressure switching unit includes a stopper 25, a spring 27 and a sending passage 29. The stopper 25 is preferably provided in the case 9 and applies an elastic force to the rotary member 19. The spring 27 applies an elastic force to the stopper 25. The sensing passage 29 is formed in the rotary member 19 to connect the initial return passage 13 to the stopper 25.

Accordingly, when the pressure in the initial return passage 13 increases abnormally, the stopper 25 is pushed toward the case 9, thereby causing the rotary member 19 to be rotated by the elastic member 21.

Preferably, a predetermined pressure, in which the stopper 25 allows the rotary member 19 to be in a rotatable state, can be set to a value which would not deform the parts forming the fuel supply system and cause fuel leakage. It can be set appropriately on a case-by-case basis. An example of the pressure, however, can be about 1.9 bar.

The rotary member 19 includes a fixing groove 31 into which the stopper 25 is fitted after the rotation of the rotary member 19. As a result, the state where the rotary member 19 is rotated is stably maintained as described above. In this case the final supply passage 15 serves as a fuel supply line and the final return passage 17 serves as a fuel return line.

The operation of the systems according to the preferred embodiments of the present invention will be described below.

As shown at the upper side of FIG. 2, before the rotation of the rotary member 19, the initial supply passage 11 of the rotary member 19 connects the pump port 1 of the case 9 to the first variable port 5, and the initial return passage 13 connects the return line port 3 to the second variable port 7.

In this case, when an operator correctly provides a fuel filter so that the fuel filter is connected to the first variable port 5 and the fuel tank is connected to the second variable port 7, fuel passing through the fuel filter is supplied to the high-pressure pump via the first variable port 5, the initial supply passage 11, and the pump port 1. Further, fuel used to lubricate the high-pressure pump and fuel retrieved from the common rail are mixed with each other to be retrieved to the fuel tank via the return line port 3, the initial return passage 13, and the second variable port 7, which forms a circulation system.

In the case described above, the pressure in the fuel return line does not increase abnormally and the rotary member 19 thus does not rotate.

If, however, the operator incorrectly provides the fuel filter by connecting the second variable port 7 to the fuel filter and the first variable port 5 to the fuel tank, the fuel flow is suppressed by the fuel filter during the operation of an engine and then, the pressure in the fuel return line begins to increase abnormally.

When the pressure in the fuel return line becomes higher than a predetermined pressure, the pressure in the sensing passage 29 connected to the initial return line also increases and pushes the stopper 25 to the outside. As a result, the rotary member 19 comes into a rotatable state with respect to the case 9, and the elastic member 21 rotates the rotary member 19 to switch the passage to be in the state as shown at the bottom of FIG. 2.

In other words, the second variable port 7 connected to the fuel filter communicates with the pump port 1 via the final supply passage 15 so that fuel supplied from the fuel filter can be supplied to the high-pressure pump. Further, the first variable port 5 connected to the fuel tank communicates with the return line port 3 via the final return passage 17 so that fuel returned from the high-pressure pump can be normally retrieved to the fuel tank.

Since the stopper 25 is fitted into the fixing groove 31, the above-mentioned state can be stably and constantly maintained.

For this reason, even when a fuel filter is incorrectly assembled, it is possible to automatically switch fuel flow so as to prevent damages to parts of the fuel supply system and fuel leakage.

According to preferred embodiments of the present invention, when fuel pressure in the fuel return line becomes higher than a predetermined pressure, passages of the fuel supply and return lines are automatically switched as described above. As a result, even when the fuel supply and return lines are incorrectly connected by an incorrect assembly of the fuel filter, it is possible to prevent damages to the fuel supply system and fuel leakage.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A system for automatically changing fuel passages for a diesel engine, the system comprising:

a case including a pump port connected to an inlet of a high-pressure pump, a return line port provided with a fuel return line connected to a common rail and the high-pressure pump, a first variable port connected to a fuel filter, and a second variable port connected to a fuel tank;

a rotary member including an initial supply passage that is rotatably provided in the case and connects the pump port to the first variable port before the rotation of the rotary member, an initial return passage that connects the return line port to the second variable port before the rotation of the rotary member, a final supply passage that connects the pump port to the second variable port after the rotation of the rotary member, and a final return passage that connects the return line port to the first variable port after the rotation of the rotary member;

a pressure switching unit maintaining a pre-rotation state of the rotary member and allowing the rotary member to rotate with respect to the case when pressure in the fuel return line increases to a level higher than a predetermined pressure; and an elastic member rotating the rotary member with respect to the case when the rotary member is switched into a rotatable state by the pressure switching unit.

2. The system as defined in claim 1, wherein the pump port and the first variable port are provided on a first imaginary straight line passing through the case, and the return line port and the second variable port are provided on a second imaginary straight line passing through the case so as to be parallel to the first imaginary straight line.

3. The system as defined in claim 2, wherein the case has a cylindrical shape, and the first imaginary line and the second imaginary line pass through the peripheral surface of the case so as to be spaced apart from each other in a longitudinal direction of the cylindrical shape.

4. The system as defined in claim 3, wherein the rotary member has a cylindrical shape similar to the cylindrical shape of the case so as to be rotatably inserted into the case.

5. The system as defined in claim 4, wherein a rotational bearing is provided between the rotary member and the case to guide the rotation of the rotary member with respect to the case along the circumferential direction.

6. The system as defined in claim 1, wherein the pressure switching unit includes a stopper that is provided in the case and applies an elastic force to the rotary member, a spring that applies an elastic force to the stopper, and a sensing passage that is formed in the rotary member to connect the initial return passage to the stopper.

7. The system as defined in claim 6, wherein the rotary member includes a fixing groove into which the stopper is fitted after the rotation of the rotary member.

* * * * *